US005722017A

United States Patent [19]

Caruthers, Jr. et al.

[11] Patent Number: 5,722,017

[45] Date of Patent: Feb. 24, 1998

[54] LIQUID DEVELOPING MATERIAL REPLENISHMENT SYSTEM AND METHOD

[75] Inventors: Edward B. Caruthers, Jr., Rochester; Raymond W. Stover, Webster; George A. Gibson; James R. Larson, both of Fairport, all of N.Y.

[73] Assignee: Xerox Corporation, Stamford, Conn.

[21] Appl. No.: 726,872

[22] Filed: Oct. 4, 1996

[51] Int. Cl.[6] ..... G03G 15/10

[52] U.S. Cl. ..... 399/238; 222/DIG. 1; 399/28; 399/29; 399/30; 399/57

[58] Field of Search ..... 399/29, 30, 28, 399/57, 238, 239, 58, 61, 62, 64, 65; 222/DIG. 1; 347/43, 89; 430/117

[56] References Cited

U.S. PATENT DOCUMENTS

| | | | |
|---|---|---|---|
| 3,699,992 | 10/1972 | Knechtel et al. | 399/57 |
| 4,310,238 | 1/1982 | Mochizuki et al. | 399/64 |
| 4,358,196 | 11/1982 | Mugrauer | 399/257 |
| 4,660,152 | 4/1987 | Downing et al. | 222/DIG. 1 |
| 4,767,689 | 8/1988 | Bibl et al. | 430/45 |
| 4,860,924 | 8/1989 | Simms et al. | 222/56 |
| 5,155,528 | 10/1992 | Morishige et al. | 399/64 |
| 5,231,454 | 7/1993 | Landa . | |
| 5,235,391 | 8/1993 | Aimoto | 399/29 |
| 5,345,296 | 9/1994 | Wellings | 399/238 |
| 5,369,476 | 11/1994 | Bowers et al. | 399/49 |
| 5,387,760 | 2/1995 | Miyazawa et al. | 399/239 |
| 5,404,210 | 4/1995 | Day | 399/225 |
| 5,477,313 | 12/1995 | Kuramochi et al. | 399/239 |
| 5,519,473 | 5/1996 | Morehouse, Jr. et al. | 399/239 |
| 5,548,385 | 8/1996 | Takai et al. . | |
| 5,623,715 | 4/1997 | Clark | 399/57 |

*Primary Examiner*—Matthew S. Smith
*Attorney, Agent, or Firm*—Denis A. Robitaille

[57] ABSTRACT

A liquid developing material replenishment system wherein an apparatus for developing an electrostatic latent image with a liquid developing material includes a liquid developing reservoir for providing a supply of operative liquid developing material to the developing apparatus, and a liquid developing material supply is coupled to the liquid developing material reservoir for providing a supply of liquid developing concentrate to the liquid developing material reservoir for replenishing the supply of operative liquid developing material in the liquid developing reservoir. A predetermined amount of operative liquid developing material is periodically and/or systematically discharged from the liquid developing material reservoir to remove contaminated liquid developing material from the reservoir. In addition, a predetermined amount of liquid developing material concentrate is systematically dispensed from the liquid developing material supply to the liquid developing material reservoir so as to extend the useful life of the operative liquid developing material therein.

27 Claims, 2 Drawing Sheets

LIQUID DEVELOPING MATERIAL REPLENISHMENT SYSTEM AND METHOD

Figure 1:
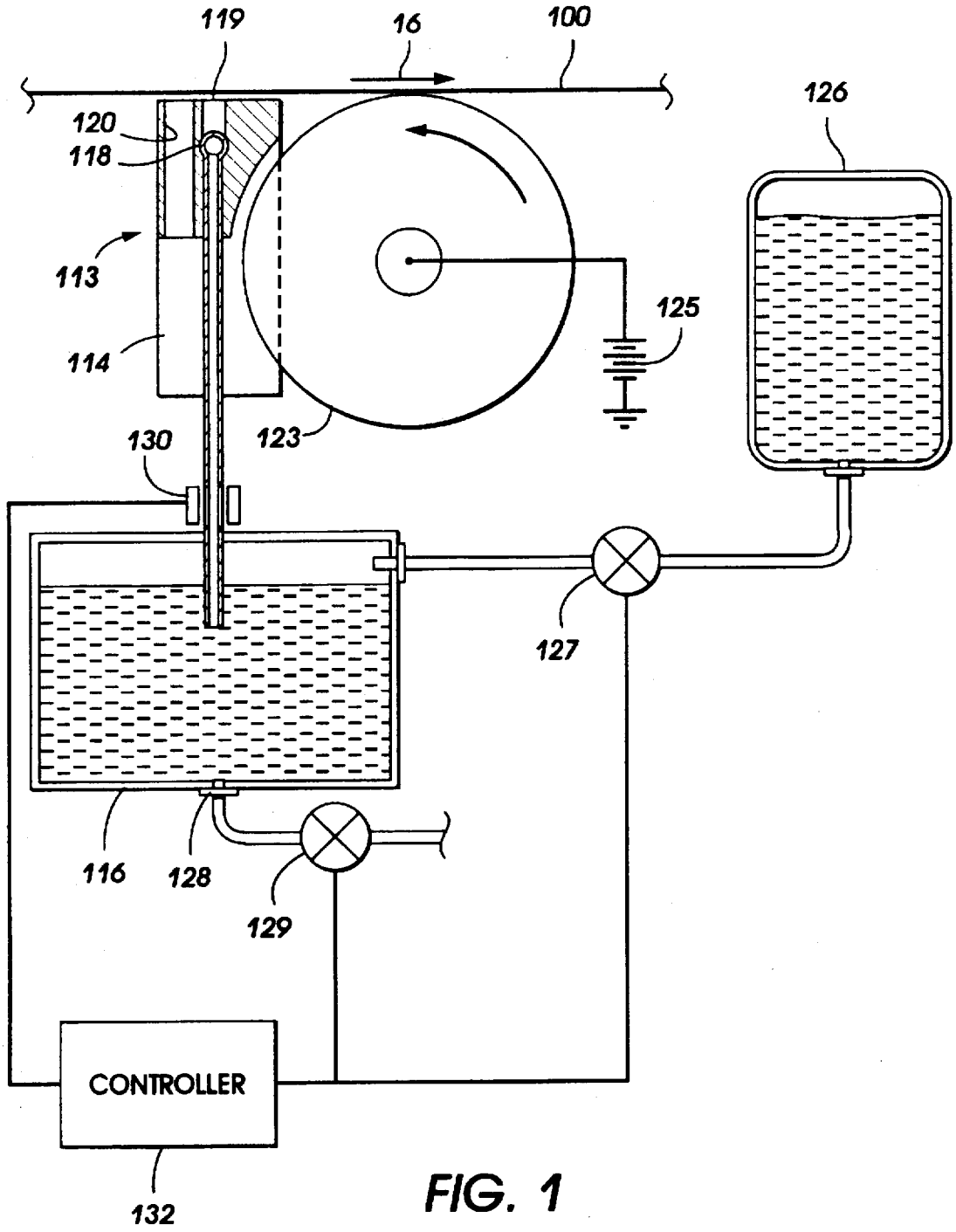

This invention relates generally to a liquid developing material-based electrostatographic printing machine, and, more particularly, concerns a development apparatus having a liquid developing material replenishment system for maximizing liquid developing material life in a supply reservoir.

Generally, the process of electrostatographic copying is initiated by exposing a substantially uniformly charged photoreceptive member to light in image configuration corresponding to an original document or electronic file. Exposing the charged photoreceptive member to a light image discharges the photoconductive surface thereof in selected areas while maintaining the charge in other image areas, resulting in the creation of an electrostatic latent image on the photoreceptive member. This latent image is subsequently developed into a visible image by a process in which developing material is deposited onto the surface of the photoreceptive member. Typically, this developing material is provided in the form of a dry powder material comprising carrier granules having toner particles adhering triboelectrically thereto, wherein the toner particles are electrostatically attracted from the carrier granules to the latent image for forming a powder toner image on the photoreceptive member. Alternatively, liquid developing materials comprising marking particles (or so-called toner solids) dispersed in a carrier liquid have been utilized, wherein the liquid developing material is applied to the latent image with the marking particles being attracted through the liquid toward the image areas to form a developed liquid image. Regardless of the type of developing material employed, the toner or marking particles are attracted to the latent image and subsequently transferred from the photoreceptive member to a copy substrate, either directly or by way of an intermediate transfer member. Once on the copy substrate, the image may be permanently affixed to provide a so-called hard copy of the original document or file. In a final step, the photoreceptive member is cleaned to remove any electrostatic charge and/or residual developing material from the photoconductive surface in preparation for subsequent imaging cycles.

The above-described electrostatographic reproduction process is well known and is useful for light lens copying from an original document, as well as for printing applications involving electronically generated or stored documents. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, so-called DAD, or "write black" systems, while other printing processes, such as light lens generated imaging systems, develop toner on the charged areas, so-called CAD, or "write white" systems. The instant invention applies to systems which implement either of such printing processes.

Conventional electrostatographic reproduction processes as described above can be adapted to produce multicolor images by altering the basic process in some manner. For example, the charged photoconductive member may be sequentially exposed to a series of color separated images of the original in order to form a plurality of latent electrostatic images. Each color separation is then developed with a developing material containing a complimentary colorant which is the subtractive compliment of the color separated image. Thereafter, each color separated image is superimposed in registration with one another to produce a multicolor image. The fidelity of the final output copy produced by this technique is dependent, to a large extent, on how well the subtractive colorants mix or combine when brought together to reflect the colors found in the original.

Conventional electrostatographic imaging techniques previously directed to monochrome image formation have also been extended to the creation of highlight color images, wherein independent, differently colored, monochrome images are created on an output copy sheet. One exemplary highlight color process is described in U.S. Pat. No. 4,078,929 issued to Gundlach, wherein independent images are created using a raster output scanner to form a tri-level image including a pair of charge patterns having different potential values corresponding to different image areas and a non-image background area generally having a potential value intermediate the two image areas. As disclosed therein, each charge pattern is developed with toner particles of a first or second colors. Among other advantages, this process allows for faithful color reproduction or the use of so-called custom colors since the color of each image is directly related to the color of the toner particles deposited thereon, and does not depend on the mixture of subtractive colorants to produce the desired color output.

As previously noted, conventional electrostatographic imaging processes have also been modified such that the use of liquid developing materials is well known, wherein liquid developing material-based systems have been shown to provide many advantages, and generally produce images of higher quality than images formed with dry toners. For example, the marking particles used in liquid developing materials can be made to be very small without resulting in problems often associated with very small particle powder toners, such as airborne contamination which can adversely affect machine reliability and can create potential health hazards. In addition, with particular regard to multicolor imaging, liquid developing materials have been shown to be economically attractive, particularly if surplus liquid carrier can be economically recovered without cross contamination of colorants. Further, full color prints made with liquid developing materials can provide much higher fidelity images due to the very small marking particles, and can be processed to a substantially uniform finish, whereas uniformity of finish is difficult to achieve with powder toners due to variations in the toner pile height among other factors.

One of the key issues associated with multicolor imaging processes, and, in particular, with so-called image-on-image processes, a process which will be described in great detail herein, is contamination of developing material supply reservoirs with developing materials of other colors from previously developed images. That is, developing material of a first color which has been applied to the photoreceptor to produce a first color developed image may separate from the photoreceptor during subsequent processing and may become captured or retrieved by a subsequent development step such that the first color marking particles become incorporated into, and contaminate, the developing material of a different color. It has been found that, even at very low levels, downstream developing material reservoirs may become sufficiently contaminated with upstream toner materials over time such that an unacceptable color shift in the downstream developing material will result. Contamination can also become an issue in other multicolor imaging architectures, including tandem systems wherein back transfer may exist.

Clearly, such contamination degrades the color quality of output copies and results in a significant reduction in the useful life of the developer material. This, in turn, generates increased frequency of service calls due to copy quality dissatisfaction and frequently results in the premature replacement of developer material. While this wasteful practice may be justifiable in some situations where copy quality can be restored it is desirable to minimize or eliminate the issue of developer material contamination to reduce the amount of service calls associated therewith and to extend the useful life of developer materials in electrostatic printing machines. Thus, it is desirable to provide a system that compensates for color contamination in developer reservoirs in order to reduce operator intervention which results in machine downtime, and to reduce waste in the form of developing materials as well as unacceptable output copy quality.

With particular regard to liquid developing material based imaging processes, it is noted that liquid developing materials generally include a liquid phase, comprising an insulating carrier liquid such as an isoparaffinic hydrocarbon, and a solid phase, comprising marking particles composed of a pigment and a binder, as well as other optional materials, wherein the solid phase marking particles are dispersed or suspended in the liquid phase carrier. In addition, liquid developing materials also typically include a small amount of charge director compound for insuring that the marking particles are uniformly charged to the same polarity, either positive or negative, depending upon the particular application. Charge director compounds are generally ionic compounds capable of imparting an electrical charge to marking particles of a desired polarity and a uniform magnitude so that the particles may be electrophoretically deposited on a charged surface (e.g., the photoreceptive member). The desired charging is achieved by providing a constant optimum concentration of charge director compound in the developing material liquid.

In general, when a copy or print is made using liquid developing material, a substantially uniform amount of carrier liquid containing an associated amount of liquid phase charge director is deposited over the entire surface of the photoreceptive imaging surface along with a variable amount of marking particles proportional to the image areas being developed, wherein the marking particles also include an associated amount of solid phase charge director as well as some liquid carrier. Accordingly, during the development of a latent image, a fixed amount of carrier liquid and charge director are depleted from a supply of liquid developing material, along with a variable quantity of marking particles as well as liquid carrier and charge director associated with the marking particles. The depletion amounts of each of these components depends on the amount of image and non-image areas on the latent image being developed.

Clearly, the application of liquid developer material to a photoconductive surface for image development results in the depletion of the overall amount of liquid developer in the liquid developing material reservoir. In practice, the liquid reservoir is continuously replenished by the addition of a concentrated dispersion of marking particles and charge director in carrier liquid, as necessary. Thus, in practice, a relatively constant concentration of toner particles, liquid carrier, and charge director is maintained in an operational liquid developing material reservoir. The rate of replenishment of carrier liquid may be controlled by monitoring the overall amount or level of liquid developer in the reservoir, whereas the rate of replenishment of toner particles and/or charge director may be controlled by monitoring the concentration of toner particles or charge directors in the liquid developer in the reservoir.

The present invention contemplates a liquid developing material replenishment system, wherein predetermined quantities of liquid developing material concentrate is added to the operational liquid developing material reservoir while a selected amount of contaminated developing material is removed from the liquid developing material reservoir, for eliminating, or at least minimizing the effects of developer material contamination, as described hereinabove. Thus, the replenishing system of the present invention operates to enhance the overall developer life in an operational liquid developing material reservoir by detecting contamination levels in the operational liquid developing material reservoir removing a predetermined amount of contaminated liquid developing material therefrom, and systematically replacing the removed liquid developing material with a predetermined amount of liquid developing material concentrate.

The following disclosures may be relevant to some aspects of the present invention:

U.S. Pat. No. 4,860,924

Patentee: Simms et. al.

Issued: Aug. 29, 1989

U.S. Pat. No. 5,231,454

Patentee: Landa

Issued: Jul. 27, 1993

U.S. Pat. No. 5,548,385

Patentee: Takai et al.

Issued: Aug. 20, 1996

The relevant portions of the foregoing patents may be briefly summarized as follows:

U.S. Pat. No. 4,860,924, incorporated by reference herein, discloses a copier wherein charge director is supplied to a liquid developer in response to a conductivity measurement thereof. Toner concentrate deficient in charge director is supplied to the liquid developer in response to an optical transmissivity measurement thereof. Conductivity is measured by a pair of spaced electrodes immersed in the developer and through which a variable alternating current is passed. A variable capacitor neutralizes the inherent capacitance of the electrodes. A phase sensitive detector is provided with a reference voltage having the same phase shift as that caused by capacitive effects. The conductivity measurement is corrected in response to a developer temperature measurement.

U.S. Pat. No. 5,231,454 discloses a system for imaging utilizing a liquid developer material including carrier liquid, toner particles and charge director, wherein the system includes a liquid developer reservoir coupled to a developer electrode for developing an electrostatic image with the liquid developer from the reservoir to form a developed image. That system includes an apparatus responsive to the charge level of the liquid developer in the liquid developer reservoir for supplying charge director thereto while maintaining the charge level of the liquid developer in the reservoir.

U.S. Pat. No. 5,548,385 discloses a developer device that gradually replaces degraded dry toner developer with fresh developer. The developer device of that patent is provided with a developer vessel for storing therein a developer material composed of toner particles and carrier granules, wherein a target ratio of toner particles for a detected quantity of the developer material is computed. In that device, a toner concentration detector sensor is also provided for detecting the ratio of toner particles to develop material in the developer vessel. In order to set the detected toner ratio of toner particles equal to the target ratio, a quantity of toner particles to be additionally supplied to the developer vessel is controlled. As a result the ratio of toner particles to the developer material stored in the developer vessel can be maintained in a predetermined ratio for insuring a desirable image quality.

In accordance with one aspect of the present invention, there is provided an apparatus for developing an electrostatic latent image with a liquid developing material, comprising: a liquid developing material reservoir for providing a supply of operative liquid developing material to the developing apparatus; a liquid developing material supply coupled to the liquid developing material reservoir for providing a supply of liquid developing material concentrate thereto, so as to replenish the supply of operative liquid developing material in the liquid developing material reservoir; means for periodically discharging a predetermined amount of operative liquid developing material from the liquid developing material reservoir to remove contaminated liquid developing material therefrom; and means for systematically dispensing a predetermined amount of liquid developing material concentrate from the liquid developing material supply to the liquid developing material reservoir so as to extend the useful life of the operative liquid developing material therein.

In accordance with another aspect of the invention, a multicolor electrostatic graphic printing apparatus including a plurality of development subsystems for developing electrostatic latent images with different colored liquid developing material is provided wherein liquid developing material from a first development subsystem may become undesirably intermixed with the different colored liquid developing material of a second development subsystem. At least one subsystem of the multicolor electrostatographic printing apparatus comprises: a liquid developing material reservoir for providing a supply of operative liquid developing material to the developing apparatus; a liquid developing material supply coupled to the liquid developing material reservoir for providing a supply of liquid developing material concentrate thereto, so as to replenish the supply of operative liquid developing material in the liquid developing material reservoir; means for periodically discharging a predetermined amount of operative liquid developing material from the liquid developing material reservoir to remove contaminated liquid developing material therefrom; and means for systematically dispensing a predetermined amount of liquid developing material concentrate from the liquid developing material supply to the liquid developing material reservoir so as to extend the useful life of the operative liquid developing material therein.

In accordance with yet another aspect of the present invention, a multicolor electrostatographic printing process wherein a plurality of electrostatic latent images are developed with different colored liquid developing material by means of a plurality of developing apparatus, and further wherein the liquid developing material from a first developing apparatus may become undesirably intermixed with a different colored liquid developing material of a second developing apparatus is provided. The multicolor electrostatographic printing process comprises the steps of; providing a liquid developing material reservoir for supplying operative liquid developing material to the developing apparatus; providing a stored supply of liquid developing material concentrate coupled to the liquid developing material reservoir to replenish the supply of operative liquid developing material in the liquid developing material reservoir; periodically discharging a predetermined amount of operative liquid developing material from the liquid developing reservoir to remove contaminated liquid developing material therefrom; and systematically dispensing a predetermined amount of liquid developing material concentrate to the liquid developing reservoir so as to extend the useful life of the operative liquid developing material therein.

Figure 2:
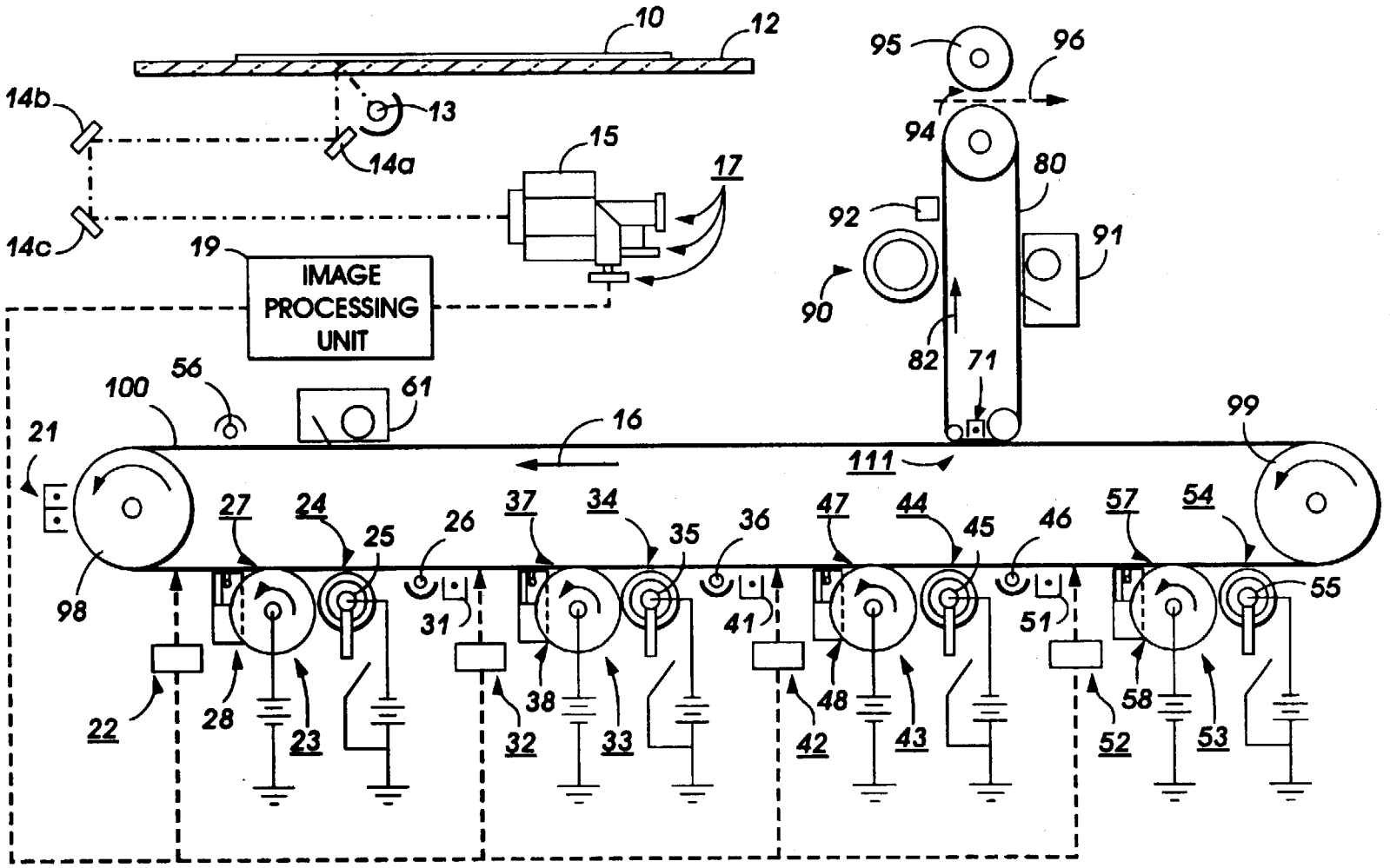

Other aspects of the present invention will become apparent as the following description proceeds and upon reference to the drawings, in which:

FIG. 1 is a schematic elevational view of an exemplary liquid developing material development system incorporating a liquid developing material replenishment system in accordance with the present invention therein; and FIG. 2 is a schematic elevational view of an exemplary color electrostatographic printing machine incorporating a liquid developing material replenishment system in accordance with the present invention.

For a general understanding of the features of the present invention, reference is made to the drawings, wherein like reference numerals have been used throughout to designate identical elements. FIG. 2 illustrates a so-called image-on-image, multicolor liquid developing material-based electrostatographic printing machine incorporating the features of the present invention. Inasmuch as the art of electrostatographic printing is well known, the various processing stations employed in the printing machine of FIG. 2 will be described briefly with reference thereto. It will become apparent from the following discussion that the replenishment system of the present invention may be equally well suited for use in a wide variety of printing machines and is not necessarily limited in its application to the particular single-pass, image-on-image multicolor system described herein. Moreover, while the replenishment system of the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning initially to FIG. 2, a photoreceptive member 100, provided in the form of a photoreceptor belt, is rotated along a curvilinear path defined by rollers 98 and 99. A photoreceptor member is capable of receiving and holding an electrical charge and releasing that electrical charge when exposed to light. A typical photoreceptor belt preferably includes a base substrate, having a conductive ground plane and a photoconductive layer thereon, and may also include an optional adhesive layer, an optional hole blocking layer, a charge generating layer, a charge transport layer, and, in some embodiments, an anti-curl backing layer. The belt 100 is initially charged to a uniform charge potential by means of charging unit 21, which typically includes a corona generating device capable of spraying ions onto the surface of the photoreceptive member 100 for generating a relatively high, substantially uniform charge thereon.

After a uniform charge is placed on the surface of the photoreceptive member 100, the electrostatographic printing process proceeds by exposing the charged photoreceptor to light in image configuration either by means of a computer generated image input or by placing an input document 10 onto the surface of a transparent imaging platen 12, for copying thereof. In one preferred exposing process particularly useful in multicolor imaging, scanning assembly (preferably comprising a high powered light source 13, mirrors 14*a*, 14*b* and 14*c*, a series of lenses (not shown), a dichloric prism 15 and a plurality of charge-coupled devices (CCDs) 17, operating in association with one another) scans the input document, whereby light from the light source 13 is directed onto the input document 10 with the light reflected from the color document 10 being transmitted to the CCDs 17. For color processing, the reflected light is separated into the three primary colors by the dichloric prism 15 such that each CCD 17 provides an analog output voltage which is proportional to the intensity of the incident light of each of the primary colors. Thereafter, the analog signal from each CCD 17 is converted into a digital signal corresponding to individual picture elements making up the original input document. These digital signals, which represent the blue, green, and red density levels of the input image, are input into the image processing unit 19 where individual bitmaps representing the exposive, color separation and color components of each picture element (yellow (Y); magenta (M); cyan (C); and black (Bk) are generated. The image processing unit 19 may also contain a shading correction unit, an undercolor removal unit (UCR), a masking unit, a dithering unit, a gray level processing unit, and other imaging processing subsystems and/or circuitry as known in the art. The image processing unit 19 can operate in real time or can store bitmap information for subsequent image processing.

The digital output signals generated by the image processing unit 19 are subsequently transmitted to a series of individual raster output scanners (ROSs) 22,32,42 and 52 for writing complementary color image bitmap information onto the charged photoreceptive belt 100 by selectively exposing the surface thereof to erase the electrical charges thereon. It will be recognized that the present description is directed toward a Recharge, Expose, and Develop (REaD) process, wherein the charged photoconductive surface of photoreceptive member 100 is serially exposed to record a series of latent images thereon corresponding to the subtractive color of one of the colors of the appropriately colored toner particles at a corresponding development station. Thus, the photoconductive surface is systematically recharged and re-exposed to record latent images thereon corresponding to the subtractive color on the original. These latent images are subsequently serially developed with appropriately colored marking particles, as will be described until all the different color toner layers are deposited in superimposed registration with one another on the photoconductive surface. It should be noted that either discharged area development (DAD), wherein discharged portions are developed, or charged area development (CAD), wherein charged areas are developed, can be employed, as is well known in the art.

An exemplary apparatus for carrying out the development process utilizing liquid developing materials is depicted schematically at reference numerals 27, 37, 47 and 57. Each developer apparatus 27, 37, 47 and 57 includes a developing material applicator 28,38,48 or 58 for transporting a different color liquid developing material into contact with the electrostatic latent image on the photoreceptor surface. By way of example, developing material applicator 28 might transport yellow colored liquid developer material, developer material applicator 38 might transport magenta colored liquid developer material, applicator 48 might transport cyan colored liquid developer material, and applicator 58 might transport black colored liquid developer material. Each different color liquid developing material comprises pigmented toner particles and charge directors disseminated through a liquid carrier, wherein the toner particles are charged to a polarity opposite in polarity to the charged latent image on the photoconductive surface such that the toner particles pass by electrophoresis to the electrostatic latent image on photoreceptor belt 100 to create a visible developed image thereon. Each of the developer apparatus 28, 38, 48 and 58 are substantially identical to one another and represent one of various known apparatus that can be utilized to apply liquid developing material to the photoconductive surface. It will be understood that various alternative designs for development systems are disclosed in the art (see, for example, U.S. Pat. Nos. 4,733,273; 4,883,018; and 5,355,201, among others), and that the particular liquid developing material development system design disclosed herein will not create a limitation on the present invention.

As previously indicated, the liquid developing material generally comprises marking particles and a charge director compound dispersed in a liquid carrier medium. Generally, the liquid carrier medium is present in a large amount in the developing material composition, and constitutes that percentage by weight of the developer not accounted for by the other components. The liquid medium is usually present in an amount of from about 80 to about 99.5 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

The marking or so-called toner particles can comprise any particle material that is compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in amounts of from about 5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like.

Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which have been previously indicated to be incorporated by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

In addition to the liquid carrier vehicle and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

After the liquid developing material has been transported into contact with the electrostatic latent image on the photoreceptor surface, the image is developed and a selected amount of liquid developing material, and in particular the liquid carrier portion of the liquid developing material that is deposited on the surface of the photoreceptor belt is preferably reduced. To this end, each developer apparatus system of FIG. 2 is provided with metering rolls identified by reference numerals 23, 33, 43 and 53, which are positioned slightly downstream of, and adjacent to respective developing material applicators 27, 37, 47 and 57, in the direction of movement 16 of the photoreceptor 100. As shown, the metering roll 23 may be electrically biased by supplying an AC or a DC voltage thereto for repelling or attracting toner particles present in the liquid developing material on the photoreceptor belt.

Preferably the peripheral surface of each metering roller 23, 33, 43 and 53 is situated in close proximity to the surface of the photoreceptor 100 and may or may not contact the surface of the photoreceptor 100 and/or the liquid coating layer thereon. In addition, each metering roller is preferably rotated in a direction opposite the path of movement of the photoreceptor 100 in order to create a substantial shear force against the layer of liquid developing material present thereon. This shear force removes a predetermined amount of excess developing material, in particular carrier liquid, from the surface of the photoreceptor, with the excess developing material eventually falling away from the rotating metering roll for collection in a reservoir or other liquid developer collection and reclaim system, as will be described in greater detail with respect to FIG. 1.

After image development, the liquid image on photoconductor 100 may be conditioned to compress the image and remove some of the liquid carrier therefrom, as shown, for example, by U.S. Pat. No. 4,286,039, among various other patents. An exemplary apparatus for image conditioning is shown at reference numeral 24, 34, 44 and 4, each comprising an electrically biased roller, which may include a porous body and a perforated skin covering. Each image conditioning roller is typically biased to a potential having a polarity which inhibits the departure of toner particles from the image on the photoreceptor surface 100 while compressing the toner particles of the image and further wiping additional liquid carrier therefrom. In operation, the image conditioning roller rotates against the liquid image on belt 100 such that the porous body thereof absorbs excess liquid from the surface of the image through the pores and perforations of the roller skin covering.

In an exemplary image conditioning system, a vacuum source (not shown) may also be provided, coupled to the interior of the roller for creating an airflow through the porous roller body to draw liquid away from the surface of the photoreceptor, thereby increasing the percentage of toner solids in the developed image. The optional vacuum source, typically located along one end of a central cavity, draws liquid through the roller surface to a central cavity for depositing the liquid in a receptacle or some other location which permits either disposal or recirculation of the liquid carrier. The porous roller is thus continuously discharged of excess liquid to provide continuous removal of liquid from the image on belt 100. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

After image conditioning of the first developed image, the image on belt 100 is advanced to a lamp 26 where any residual charge left on the photoreceptor 100 is extinguished by flooding the photoconductive surface with light from lamp 26. Thereafter, charging imaging and development are repeated for subsequent color separations by first recharging and reexposing the belt 100, whereby color image bitmap information is superimposed over the previously developed latent image. Preferably, for each subsequent exposure an adaptive exposure processor is employed that modulates the exposure level of the raster output scanner (ROS) for a given picture element as a function of the toner previously developed at the picture element site, thereby allowing toner layers to be made independent of each other, as described in commonly assigned U.S. Pat. No. 5,477,317. The reexposed image is next advanced through a development station and subsequently through an image conditioning station and each step is repeated as previously described to create a multi-layer image made up of yellow, magenta, cyan and black toner particles as provided via each developing station 27, 37, 47 and 57. It should be evident to one skilled in the art that the color of toner at each development station could be provided in a different arrangement than that described herein.

After the multi-layer image is created on the photoreceptive member, it may be advanced to an intermediate transfer station where charging device 71 generates a charge for electrostatically transferring the image from the photoconductive belt 100 to an intermediate transfer member 80. The intermediate member 80 may be in the form of either a rigid roll or an endless belt, as shown in FIG. 2, having a path defined by a plurality of rollers in contact with the inner surface thereof. The intermediate member preferably comprises a multi-layer structure comprising a substrate layer having a resistivity of about $10^6$ ohm-cm and an insulating top layer having a dielectric constant of approximately 10 and a resistivity of about $10^{13}$ ohm-cm. The top layer may also have an adhesive release surface. It is also preferred that both layers have a similar hardness of less than about 60 durometer. Preferably, both layers are composed of Viton™ (a fluoroelastomer of vinylidene fluoride and hexafluoropropylene manufactured by E. I. DuPont de Nemours Co. of Wilmington, Del.) which can be laminated together. The intermediate transfer member is typically dimensionally stable in nature for providing uniform image deposition which results in a controlled image transfer gap for enhanced image registration.

The multi-layer image on the intermediate transfer member 80 may be image conditioned in a manner similar to the image conditioning process described hereinabove with respect to the developed image on the photoconductive belt 100. Image conditioning on the intermediate is enabled by means of a roller 90 which conditions the image by reducing fluid content while inhibiting the departure of toner particles from the image as well as compacting the toner image. Preferably, roller 90 conditions the multi-layer image so that the image has a toner composition of more than 50 percent solids. In addition, the multi-layer image present on the surface of the intermediate member may be transformed into a tackified or molten state by the use of heat, as may be provided by optional heating element 92. More specifically, heating element 92 may be provided to heat both the external wall of the intermediate member and generally maintains the outer surface of member 80 at a temperature sufficient to cause the toner particles present on the surface to melt, due to the mass and thermal conductivity of the intermediate member. The toner particles on the surface maintain the position in which they were deposited on the outer surface of member 80, so as not to alter the image pattern which they represent while softening and coalescing due to the application of heat from the exterior of member 92.

Thereafter, the intermediate transfer member continues to advance in the direction of arrow 82 to a transfix nip 94 where the tackified toner particle image is transferred, and bonded to a recording sheet 96 transported through transfix nip 94. At the transfix nip 94, the toner particles are forced into contact with the surface of recording sheet 96 by a normal force applied through backup pressure roll 95. Some of the advantages provided by the use of an intermediate transfer member include reduced heating of the recording sheet as a result of the toner or marking particles being pre-melted on the intermediate, as well as the elimination of an electrostatic transfer device for transferring charged particles to a recording sheet.

After the developed image is transferred to intermediate member 80, residual liquid developer material may remain on the photoconductive surface of belt 100. As a result, a cleaning station 61 is typically provided, comprising a roll member, formed of any appropriate synthetic resin which may be driven in a direction opposite to the direction of movement of belt 100, for contacting the photoreceptor to wipe the photoconductive surface clean. A number of photoconductor cleaning devices exist in the art, any of which would be suitable for use with the present invention. In addition, a lamp 56 may also be provided for extinguishing any residual charge left on the photoconductive surface in preparation for a subsequent imaging cycle. Similarly, a cleaning station 91 is typically provided in association with the intermediate transfer member 80 for cleaning residual toner from the surface thereof. In this way, successive electrostatic latent images may be generated, developed and transferred to produce additional copies.

The various operations described hereinabove are preferably carried out under the control of a generally conventional microprocessor based control unit (not shown). Such a control unit may be programmed with certain novel functions and graphical user interface features for facilitating the general operation of the electrostatographic printing system. As such, updated data and status information is continually communicated to the control unit for monitoring, and initiating changes in the various operative components of the printing apparatus. All machine functions described herein, including imaging onto the photoreceptor, xerographic functions associated with developing the image and transferring the developed image, paper transport, and finishing operations may be automatically controlled via the control unit. It will be understood that the control unit may be integrated to the developing material replenishment system of the present invention.

The foregoing discussion provides a general description of the operation of an electrostatographic printing machine. The detailed structure of an exemplary liquid developer material based development system will be described hereinafter with reference to FIG. 1. It will be understood that the development system of the present invention may take many forms, as for example, the type described in previously identified U.S. Pat. Nos. 4,733,273; 4,883,018; and 5,355,201 among others, and may be utilized in a multicolor electrophotographic printing machine, or a highlight color machine or numerous other types of electrostatographic imaging systems. Multicolor printing machines may use this type of development unit wherein successive latent images are developed on top of one another to form a composite multicolor toner image which is subsequently transferred to a copy sheet or wherein single color liquid images may be transferred in superimposed registration with one another directly to the copy sheet. In addition, the developed image may be transferred directly to the copy sheet or, in the alternative, may be transferred to an intermediate member prior to transfer to the copy sheet, as described hereinabove.

Referring now to FIG. 1, an exemplary developer system will be described with the understanding that each developing system 27, 37, 47 and 57 shown, and generally described with respect to the apparatus of FIG. 2, are substantially identical thereto. In general, the only distinction between each developer unit is the color of the liquid developing material utilized therein. However, it will be noted that the first developer unit 27 may not benefit from a replenishment system of the type described herein, as that developer unit is generally not susceptible to contamination by colorants of other developer units.

As depicted in FIG. 1, the developer system includes a developing material applicator 113 coupled to an operational liquid developing material supply reservoir 116. Supply reservoir 116 maintains and provides an operative solution of liquid developing material comprised of liquid carrier, marking particles and charge director compound for application to the surface of photoreceptor 100 via developing material applicator 113.

The exemplary developing material applicator 113 includes a housing 114, defining an elongated aperture 119 extending along a longitudinal axis of the housing so as to be oriented substantially transverse to the surface of photoreceptor belt 100, along the direction of travel thereof (as indicated by arrow 16). The aperture 119 provides a path of travel for delivering liquid developing material to the applicator 113 with the gap between aperture 119 and photoreceptor 100 defining a liquid developing material application region, wherein the liquid developing material can freely flow for contacting the surface of the photoreceptor belt 100 to develop the latent image thereon. Thus, liquid developing material is pumped from the supply reservoir 116 to the applicator 113 through supply conduit 118, such that the liquid developing material flows out of the elongated aperture 119 and into contact with the surface of photoreceptor belt 100. An overflow drainage channel (not shown) partially surrounds the aperture 119 for collecting excess developing material which may not have been deposited onto the photoreceptor surface during the development process. The overflow channel is connected to an outlet port 120 for removal of excess or extraneous liquid developing material and, preferably, for directing this excess material back to supply reservoir 116 or to some other collection receptacle whereat the liquid developing material can be collected and the individual components thereof can be recycled for subsequent use.

Slightly downstream of and adjacent to the developing material applicator 113, in the direction of movement of the photoreceptor surface 100, is an electrically biased developer metering roller 123, the peripheral surface thereof being situated in close proximity to the surface of the photoreceptor 100. A DC power supply 125 is provided for maintaining an electrical bias on the metering roll 123 at a selected polarity such that image areas of the electrostatic latent image on the photoconductive surface attracts toner for developing the electrostatic latent image. This electrophoretic development process minimizes the existence of marking particles in background regions and maximizes the deposit of marking particles in image areas on the photoreceptor. The developer metering roller 123 is generally rotated in a direction opposite the movement of the photoconductor surface 100 so as to apply a substantial shear force to the thin layer of liquid developing material present in the area of the nip between the developer roller 123 and the photoreceptor 100. This shear force removes a predetermined amount of excess liquid developing material from the surface of the photoreceptor for minimizing the thickness of the liquid developing material on the surface thereof and transports this excess developing material in the direction of the developing material applicator 113. The excess developing material eventually falls away from the rotating metering roll for collection in the supply reservoir or other collection receptacle, as previously described.

In operation, liquid developing material is pumped through supply conduit 118, into the elongated aperture 119. The developing material flows in the direction of the photoreceptor 100, filling the gap between the surface of the photoreceptor and the liquid developing material applicator 113. As the belt 100 moves in the direction of arrow 16, a portion of the liquid developing material moves therewith in the direction of the metering roll 123. The metering roll is biased via the DC power supply 125, causing toner particles in the developer material to be attracted to the electrostatic latent image on the photoreceptor. The developing roller 123 also meters a predetermined amount of liquid developing material from the photoconductive surface of belt 100 and transports extraneous liquid developing material away from the photoreceptor.

The application of liquid developing material to photoconductive surface 100 via applicator 113, or by any other liquid development system, clearly depletes the overall amount of the operative solution of developing material stored in supply reservoir 116. Marking particles are depleted in the image areas; carrier liquid is depleted in the image areas (trapped by marking particles) as well as in background areas, and may also be depleted by evaporation; and charge director is depleted in the image areas (trapped in the carrier liquid), in the image areas due to adsorption onto marking particles, and in the background areas. In practice, the supply reservoir 116 is continuously replenished, as necessary, by the addition of liquid carrier, marking particles, and/or charge director into the supply reservoir 116. To that end, a replaceable container 126 having a concentrated supply of liquid developing material is typically provided in association with the supply reservoir 116, and coupled thereto, for maintaining the amount of developing material therein at a substantially constant level.

It is generally known that, because the total amount of any one of the materials making up the liquid developing material utilized to develop the image varies as a function of the area of the developed image areas and background portions of the latent image on the photoconductive surface, the specific amount of each of these components of the liquid developing material which must be added to the supply reservoir 116 varies with each development cycle. That is, a developed image having a large proportion of printed image area or having substantially a single color will cause a greater depletion of marking particles and/or charge director in the liquid developing material supply tank as compared to a developed image with a small amount of printed image area or of a single color. While the rate of the replenishment of the liquid developing material may be controlled by simply monitoring the level of liquid developer in the supply reservoir 116, in advanced systems the rate of replenishment of the liquid carrier, the marking particles, and/or the charge director components of the liquid developing material is controlled in a more sophisticated manner to maintain a predetermined concentration of the marking particles and the charge director in the operative solution stored in the supply reservoir 116. One exemplary replenishment systems of this nature include systems which measure the conductivity of the operative liquid developing material and add selective amounts of charge director compound to the reservoir as a function of the measured a conductivity, as disclosed in detail in U.S. Pat. No. 4,860,924, incorporated by reference herein. Another system of this nature is disclosed in commonly assigned U.S. patent application Ser. No. 08/551,381, also incorporated by reference herein, which describes control of the amount of carrier liquid, charge director and/or marking particles in a liquid developing material reservoir in response to the amount of each component depleted therefrom as a function of the number of pixels making up each developed image.

Thus, as the electrostatographic printing machine is used, liquid developing material is depleted therefrom and must be replenished. In addition, it has been found that liquid developing materials have a very delicate chemical balance which is easily upset by factors such as excess replenishment, aging, contamination, color intermixing, selective constituent removal during electrophoretic development, or simply heavy use. If this chemical balance is lost, poor imaging results and the entire contents of the liquid developer material supply reservoir must be replaced. Further, as the chemical balance of the liquid developer material varies with use, the contrast in color balance of the finished output copies may vary to an unacceptable level. In order to solve this problem and to provide a supply of liquid developer material having an extended useful life, the present invention contemplates the periodic discharge of contaminated or otherwise unacceptable liquid developing material from the liquid developing supply reservoir along with replenishment of the discharged material.

The approach provided by the replenishment system of the present invention, as illustrated in FIG. 1, includes, as previously indicated, a concentrate reservoir bottle 126 for providing a replenishing supply of fresh liquid developing material concentrate to the operative liquid developing material reservoir 116. The concentrate supply bottle 126 is coupled to the operative liquid developing material reservoir 116 via a supply pipe having a supply valve 127 interposed therein. In addition, the operative liquid developing material reservoir is provided with an exit port 128 situated at an appropriate position in an exterior wall of the reservoir 116. The exit port is coupled, via a drain pipe having an egress valve 129, to a collection sump (not shown) or other repository.

In accordance with the most basic concept of the present invention, a system is provided for periodically discharging a predetermined amount of operative liquid developing material from the liquid developing material reservoir 116 in order to remove unacceptably contaminated liquid developing material therefrom. In its simplest implementation, this discharge process may be initiated periodically, as a function of time or the number of images developed or any other relevant factor. However, in a more sophisticated implementation contemplated by the present invention, initiation of the process of discharging of liquid developing material will be directly related to the level of contamination in the reservoir 116. To that end, a sensing device 130, for example an optical sensor, may be provided for monitoring the color of the liquid developing material in the reservoir 116 and selectively controlling the initiation of the discharge process. Although sensing device 130 is shown in FIG. 1 in a position so as to monitor the liquid developing material being transported from the liquid developing material reservoir 116 to the developing material applicator 113 via an optically transmissive window in supply conduit 118), it will be understood by those of skill in the art that various well known sensing devices may be utilized to detect unacceptable color shifts in the liquid developing material, including devices which are submerged in the liquid developing material reservoir 116, or devices which monitor light attenuation across the volume of the reservoir 116. Sensor 130 is connected to a controller 132 which may include the machine controller, wherein the sensor 130 produces a signal upon detection of an acceptable color shift indicative of undue contamination caused by toner particle intermixing among other factors. This signal is then transmitted to controller 130 for actuating valves 127 and 129 to control the flow of waste liquid developing material to be discharged from the liquid developing material supply reservoir 116 as well as the flow of replenishing liquid developing material delivered into the liquid developing material supply reservoir 116 from container 126. It will be understood that valves 127 and 129 can be replaced by pump devices or any other suitable flow control mechanisms as known in the art.

It is noted that the flow of waste developing material discharged from reservoir 116 may be directed to a waste pump, or in the alternative, to the operative supply of black liquid developing material. That is, since black color developing material is actually made up of Cyan, Yellow and Magenta, the black developing housing is least likely to attain an unacceptable color shift due to contamination by differently colored developers. Further, by causing the Cyan, Yellow and Magenta housings to be discharged at approximately the same rates, directing the waste to the black supply reservoir can maintain the color thereof within an acceptable range.

Thus, in accordance with the present invention, as the contamination level in the liquid developing material reservoir exceeds a predetermined amount, i.e. as dictated by the sensor 130, a predetermined amount of contaminated liquid developing material is discharged from the reservoir 116 via exit port 128 and a second predetermined amount of fresh liquid developing material concentrate is discharged into the reservoir 116 in order to replenish the supply of liquid developing material therein. Control of the liquid developing material replenishment system of the present invention requires a predetermined knowledge of acceptable color shift ($\Delta E$) which is permissible in the printing system, with the understanding that acceptable color shift can vary depending on system parameters and color fidelity requirements. However, assuming a given allowable color shift, one can determine the allowable contamination level of the transferred mass per unit area (TMA). Thereafter, assuming that the transferred developer mass per unit area is related to the developed mass per unit area (DMA), one can further calculate the allowable toner concentration contamination level from the allowable developed mass per unit area contamination. This, in turn, permits the calculation of the amount of liquid developing material which must be discharged from the operational liquid developing material reservoir as well as the amount of liquid developing material concentrate required to be replenished into the reservoir. In this way, the color of the liquid developing material in the reservoir 116 is corrected before the printed color is unacceptably contaminated. The foregoing process represents one of various exemplary processes for providing a control system for the replenishment system of the present invention. It is assumed that the selected control process can be reduced to a programmable algorithm which can be operated via controller 132 to yield extended liquid developing material life in accordance with the present invention.

It is noteworthy that alternative methods of achieving the desired result of extended liquid developer material life may be derived from the basic "discharge and replenish" concept of the present invention. One particular alternative embodiment contemplated by the present invention involves the use of color corrected liquid developing material as the replenishing liquid developing material which is provided to the operational liquid developing material reservoir 116 in order to counter the effects of cross-contamination due to intermixing of liquid developing material from an upstream developer system in the liquid developing material reservoir of a downstream developer system. Thus, it has been found that one possible method of extending the usable life of liquid developing material in a reservoir is to replenish the contaminated liquid developing material reservoir, which has been contaminated by a second color liquid developing material, with a liquid developing material of a third color to correct for the color contamination. For example, if the color order of the respective developing systems in a liquid developing material-based system is yellow, magenta, cyan and black (Y, M, D, K), it may be advantageous to correct for contamination of the magenta liquid developing material reservoir with yellow liquid developing material by adding a small amount of cyan liquid developing material to the magenta liquid developing material reservoir. Thus, the present intention also contemplates that the liquid developing material provided in supply container 126 may be some "color-corrected" liquid developing material containing a major amount of colorant corresponding to the color in the operational liquid developing material reservoir, in combination with a minor amount of at least a second colorant which would tend to correct for the color shift caused by the contaminating liquid developing material. Alternatively, each supply container 126 containing a different colorant can be coupled to each liquid developing material reservoir 116 with replenishment thereof being provided by a selective mixture from each supply container.

In review, it should be clear from the foregoing description that the liquid developing material replenishment system of the present invention is operative to remove a predetermined amount of contaminated liquid developing material from an operative liquid developing material reservoir, and systematically replacing the removed the liquid developing material with a predetermined amount of liquid developing material concentrate from a liquid developing material supply. A sensing device is provided for detecting an unacceptable level of contamination in the operational liquid developing material reservoir, as may result from the release of color toner from a first color developed image by a subsequent second color development process.

The present invention, therefore, provides a liquid developing material replenishment system that fully satisfies the aspects of the invention hereinbefore set forth. While this invention has been described in conjunction with specific embodiments thereof, it will be understood that many alternatives, modifications and variations will be apparent to those skilled in the art. Accordingly, the present invention is intended to embrace all such alternatives, modifications, and variations as fall within the spirit and broad scope of the appended claims.

We claim:

1. An apparatus for developing an electrostatic latent image with a liquid developing material, comprising:

a liquid developing material reservoir for providing a supply of operative liquid developing material to said developing apparatus;

a liquid developing material supply coupled to said liquid developing material reservoir for providing a supply of liquid developing material concentrate thereto so as to replenish the supply of operative liquid developing material in said liquid developing material reservoir;

means for periodically discharging a predetermined amount of operative liquid developing material from said liquid developing material reservoir to remove contaminated liquid developing material therefrom; and means for systematically dispensing a predetermined amount of liquid developing material concentrate from said liquid developing material supply to said liquid developing material reservoir so as to extend the useful life of said operative liquid developing material therein.

2. The apparatus of claim 1, further including sensing means for detecting an unacceptable level of contamination in said supply of liquid developing material.

3. The apparatus of claim 2, wherein said sensing means includes means for detecting a color shift in said supply of operative liquid developing material.

4. The apparatus of claim 3, wherein said sensing means includes a multiwavelength light attenuation sensing device.

5. The apparatus of claim 2, further including control means coupled to said sensing means for selectively actuating said discharging means and said dispensing means.

6. The apparatus of claim 5, wherein said control means includes:

means for calculating an amount of operative liquid developing material to be discharged from said liquid developing material reservoir; and means for calculating an amount of liquid developer material concentrate to be dispensed into said liquid developing material reservoir.

7. The apparatus of claim 1, wherein said supply of operative liquid developing material includes marking particles having a first colorant.

8. The apparatus of claim 7, wherein supply of liquid developing material concentrate includes marking particles having the first colorant and marking particles having at least a second colorant for at least partially offsetting contamination of said operative liquid developing material due to contamination caused by marking particles of a third colorant.

9. The apparatus of claim 1, further including a liquid developing material applicator coupled to said liquid developing material supply reservoir, adapted for transporting liquid developing material into contact with the electrostatic latent image.

10. The apparatus of claim 9, further including:

an electrically biased metering roll situated adjacent to, and downstream from said liquid developing material applicator.

11. The apparatus of claim 1, further including:

means for measuring conductivity of said operative liquid developing material in said reservoir; and means, responsive to said conductivity measuring means, for adding charge director to said liquid developing material reservoir.

12. A multicolor electrostatographic printing apparatus including a plurality of development subsystems for developing electrostatic latent images with different colored liquid developing material, wherein liquid developing material from a first development subsystem may become undesirably intermixed with a different colored liquid developing material of a second development subsystem, wherein at least one development subsystem comprises:

a liquid developing material reservoir for providing a supply of operative liquid developing material to said at least one development subsystem;

a liquid developing material supply coupled to said liquid developing material reservoir for providing a supply of liquid developing material concentrate thereto so as to replenish the supply of operative liquid developing material in said liquid developing material reservoir;

means for periodically discharging a predetermined amount of operative liquid developing material from said liquid developing material reservoir to remove contaminated liquid developing material therefrom; and means for systematically dispensing a predetermined amount of liquid developing material concentrate from said liquid developing material supply to said liquid developing material reservoir so as to extend the useful life of said operative liquid developing material therein.

13. The multicolor electrostatographic printing apparatus of claim 12, further including a sensing device for detecting an unacceptable level of different color liquid developing material contamination in said supply of liquid developing material.

14. The multicolor electrostatographic printing apparatus of claim 13, wherein said sensing device is operative to detect a color shift in said supply of operative liquid developing material.

15. The multicolor electrostatographic printing apparatus of claim 14, wherein said sensing device includes a multi-wavelength light attenuation sensor.

16. The multicolor electrostatographic printing apparatus of claim 13, further including a control system coupled to said sensing device for selectively actuating said discharging means and said dispensing means.

17. The multicolor electrostatographic printing apparatus of claim 16, wherein said control system includes:

means for calculating an amount of operative liquid developing material to be discharged from said liquid developing material reservoir; and means for calculating an amount of liquid developer material concentrate to be dispensed into said liquid developing material reservoir.

18. The multicolor electrostatographic printing apparatus of claim 12, wherein said supply of operative liquid developing material includes marking particles having a first colorant.

19. The multicolor electrostatographic printing apparatus of claim 18, wherein said supply of liquid developing material concentrate includes marking particles having the first colorant and marking particles having at least a second colorant for at least partially offsetting contamination of said operative liquid developing material due to contamination caused by marking particles of a third colorant.

20. The multicolor electrostatographic printing apparatus of claim 19, wherein said at least one development subsystem further includes:

an electrically biased metering roll situated adjacent to, and downstream from said liquid developing material applicator.

21. The multicolor electrostatographic printing apparatus of claim 12, wherein said at least one development subsystem further includes a liquid developing material applicator coupled to said liquid developing material supply reservoir, adapted for transporting liquid developing material into contact with the electrostatic latent image.

22. The multicolor electrostatographic printing apparatus of claim 12, further including:

means for measuring conductivity of said operative liquid developing material in said reservoir; and means, responsive to said conductivity measuring means; for adding charge director to said liquid developing material reservoir.

23. A multicolor electrostatographic printing process, wherein a plurality of electrostatic latent images are developed with different colored liquid developing material by means of a plurality of developing apparatus, and further wherein the liquid developing material from a first developing apparatus may become undesirably intermixed with a different colored liquid developing material of a second developing apparatus, comprising the steps of:

providing a liquid developing material reservoir for supplying operative liquid developing material to said developing apparatus;

providing a stored supply of liquid developing material concentrate coupled to said liquid developing material reservoir to replenish the supply of operative liquid developing material in said liquid developing material reservoir;

periodically discharging a predetermined amount of operative liquid developing material from said liquid developing material reservoir to remove contaminated liquid developing material therefrom; and systematically dispensing a predetermined amount of liquid developing material concentrate to said liquid developing material reservoir so as to extend the useful life of said operative liquid developing material therein.

24. The process of claim 23, further including the step of sensing an unacceptable level of contamination in said supply of liquid developing material.

25. The process of claim 24, wherein said sensing step includes detecting a color shift in said supply of operative liquid developing material.

26. The process of claim 25, further including the steps of:

selectively actuating said discharging step in response to detection of an unacceptable color shift in said supply of operative liquid developing material; and selectively actuating said dispensing step in response to actuation of said discharging step.

27. The process of claim 26 further including the steps of:

calculating an amount of operative liquid developing material to be discharged from said liquid developing material reservoir; and calculating an amount of liquid developer material concentrate to be dispensed into said liquid developing material reservoir.

* * * * *